US008038382B2

(12) United States Patent
Nigmatulin et al.

(10) Patent No.: US 8,038,382 B2
(45) Date of Patent: Oct. 18, 2011

(54) METHODS AND SYSTEMS FOR CONTROLLING GAS TURBINE CLEARANCE

(75) Inventors: Tagir Nigmatulin, Greenville, SC (US); Jonathan Carl Thatcher, Liberty, SC (US); Jesse Edwin Trout, Simpsonville, SC (US); Roger Clayton Walker, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 20 days.

(21) Appl. No.: 12/775,566

(22) Filed: May 7, 2010

(65) Prior Publication Data

US 2010/0218506 A1 Sep. 2, 2010

Related U.S. Application Data

(62) Division of application No. 11/532,302, filed on Sep. 15, 2006, now abandoned.

(51) Int. Cl.
*F01B 25/00* (2006.01)
*F01D 19/02* (2006.01)
*F01D 25/10* (2006.01)

(52) U.S. Cl. ..... 415/1; 415/17; 415/47

(58) Field of Classification Search ..... 415/1, 17, 415/47; 416/35, 37; 60/778, 779
See application file for complete search history.

(56) References Cited

U.S. PATENT DOCUMENTS

| | | | | |
|---|---|---|---|---|
| 3,966,354 | A | 6/1976 | Patterson | |
| 4,117,669 | A | 10/1978 | Heller | |
| 4,257,222 | A | 3/1981 | Schwarz | |
| 4,571,935 | A | 2/1986 | Rice | |
| 6,422,807 | B1 | 7/2002 | Leach et al. | |
| 6,691,019 | B2 | 2/2004 | Seeley et al. | |
| 7,165,937 | B2 * | 1/2007 | Dong et al. | 415/173.2 |

* cited by examiner

*Primary Examiner* — Edward Look
*Assistant Examiner* — Sean J Younger
(74) *Attorney, Agent, or Firm* — Sutherland Asbill & Brennan LLP

(57) ABSTRACT

Systems and methods for controlling the clearance in a gas turbine are provided. A temperature of a shaft of the gas turbine may be determined, and a desired temperature of an inner turbine shell of the turbine may be determined based upon the temperature of the shaft. The desired temperature of the inner turbine shell may be associated with a turbine clearance at which the gas turbine may be ignited. The temperature of the inner turbine shell may be altered by controlling the temperature of a gas that is circulated within the inner turbine shell, and a determination may be made that the temperature of the inner turbine shell exceeds the desired temperature. The gas turbine may be ignited subsequent to the determination that the temperature of the inner turbine shell exceeds the desired temperature.

10 Claims, 9 Drawing Sheets

METHODS AND SYSTEMS FOR CONTROLLING GAS TURBINE CLEARANCE

CROSS REFERENCES TO RELATED APPLICATIONS

This application is a divisional of co-pending U.S. patent application Ser. No. 11/532,302, entitled "METHODS AND SYSTEMS FOR CONTROLLING GAS TURBINE CLEARANCE and filed Sep. 15, 2006, the contents of which is incorporated by reference herein it its entirety.

FIELD OF THE INVENTION

The present invention relates generally to methods and systems for controlling the clearance in a gas turbine.

BACKGROUND OF THE INVENTION

A key factor in the efficiency of a turbine such as, for example, a heavy-duty gas turbine is the turbine clearance between the blade tips and the casing of the turbine. If the turbine clearance is maintained at a minimum level, the turbine will operate more efficiently because a minimum amount of air/exhaust gas will escape between the blade tips and the casing. Accordingly, a greater percentage of the air and gas entering the turbine will be used to drive the turbine blades and create work.

Due to the different thermal and mechanical growth characteristics of turbine rotor assemblies and the turbine casing, the turbine clearance may significantly change as the turbine transitions between different stages of operation such as from initial start-up to a base load steady-state condition. A clearance control system may be implemented in the turbine to address the turbine clearance conditions during the operation of the turbine.

Prior art clearance control systems typically implement a two stage or two mode control logic. The casing of the turbine is heated for all operating conditions other than base load in order to keep the turbine clearance wide open and prevent any contact between the turbine blades and turbine casing. When the turbine is operating at base load, the turbine clearance will typically be decreased by applying cool air to the turbine casing or, in the case of a two shell turbine containing both an outer and inner turbine shell, by circulating cool air through the inner turbine shell.

These prior art clearance control systems only implement two settings for turbine clearance control, rather than providing continuously modulating clearance control throughout all stages of operation of the turbine. As such, the prior art systems do not make appropriate corrections to the turbine clearance when there are variations to the load of the gas turbine and/or to the ambient conditions in which the gas turbine is operating.

The prior art clearance control systems also typically control turbine clearances according to a preset schedule in which cooling air with a specific flow rate and temperature is utilized to cool the turbine casing. For example, when a turbine is first started, the clearance control system may keep the turbine clearance wide open for a predetermined period of time sufficient for the turbine to reach a base load condition and then begin cooling the turbine casing by circulating cooling air of a predetermined temperature through the turbine casing at a predetermined flow rate. Accordingly, the prior art clearance control systems are unable to constantly monitor and adapt to any changes in the turbine clearance.

Therefore, there exists a need in the art for an improved system and method for monitoring and controlling the turbine clearance of a gas turbine.

SUMMARY OF THE INVENTION

According to one embodiment of the invention, there is disclosed a method for controlling the clearance in a gas turbine. The current clearance between a turbine blade and a casing of the gas turbine is calculated and a determination of whether the current clearance is within a predetermined clearance threshold is made. A control action is taken if the current clearance is outside of the predetermined clearance threshold.

According to an aspect of the present invention, calculating the current clearance of the gas turbine includes determining a current operating condition and a current operating temperature of the gas turbine, calculating a mechanical growth and a thermal growth of the gas turbine based on the current operating condition and the current operating temperature, and adjusting a predefined initial clearance of the gas turbine based on the calculated mechanical growth and the calculated thermal growth.

According to another aspect of the present invention, the mechanical growth and the thermal growth of the gas turbine includes one or more of a mechanical growth and a thermal growth of a shaft of the gas turbine, a mechanical growth and a thermal growth of a turbine blade of the gas turbine, the thermal growth of a shroud of the gas turbine, and the thermal growth of a casing of the gas turbine.

According to yet another aspect of the present invention, the clearance of the gas turbine is controlled for at least the first two stages of the gas turbine. According to another aspect of the present invention, the clearance of the gas turbine is controlled for one or more of a start operating condition, a purge operating condition, a shut down operating condition, a load operating condition, a no load operating condition, a base load operating condition, and a cool down operating condition.

According to another aspect of the present invention, the predetermined clearance threshold is equal to or less than approximately 0.08 inches. According to yet another aspect of the present invention, the control action taken by the control unit if the current clearance is outside of the predetermined threshold includes one or more of shutting off the gas turbine, setting off an alarm, transmitting an alarm message, or altering the clearance of the gas turbine. According to another aspect of the present invention, altering the clearance of the gas turbine includes regulating a thermal growth of an inner turbine shell of the gas turbine. According to yet another aspect of the present invention, the thermal growth of the inner turbine shell is regulated by controlling a temperature of a gas that is circulated through one or more cavities within the inner turbine shell.

According to another aspect of the present invention, the method for controlling the clearance of a gas turbine further includes determining whether the gas turbine may be ignited based on the current clearance of the gas turbine.

According to another embodiment of the invention, there is disclosed a system for controlling the clearance in a gas turbine. The system includes a compressor, a heater, and a control unit. The compressor is configured to circulate a gas through the clearance control system and through one or more cavities located in a casing of the gas turbine. The thermal growth of the casing is controlled by the gas circulating through the casing. The heater is configured to heat the gas circulated by the compressor prior to the gas being circulated through the inner turbine shell. The control unit is configured to determine a current clearance of the gas turbine and determine a desired temperature of the gas being circulated through the casing of the gas turbine in order to control the thermal growth of the casing and, therefore, control the clearance of the gas turbine. Additionally, the control unit is further configured to control the heating of the gas by the heater.

According to an aspect of the present invention, the system further includes a cooler configured to cool the gas supplied to the compressor and the control unit is further configured to control the cooler of the gas by the cooler.

According to another aspect of the present invention, the control unit determines the current clearance of the gas turbine by determining a current operating condition and a current operating temperature of the gas turbine, calculating a mechanical growth and a thermal growth of the gas turbine based on the current operating condition and the current operating temperature, and adjusting a predefined initial clearance of the gas turbine based on the calculated mechanical growth and the calculated thermal growth.

According to yet another aspect of the present invention, the mechanical growth and the thermal growth of the gas turbine includes one or more of a mechanical growth and a thermal growth of a shaft of the gas turbine, a mechanical growth and a thermal growth of a turbine blade of the gas turbine, the thermal growth of a shroud of the gas turbine, and the thermal growth of a casing of the gas turbine.

According to another aspect of the present invention, the clearance of the gas turbine is controlled for at least the first two stages of the gas turbine. According to yet another aspect of the present invention, the clearance of the gas turbine is controlled for one or more of a start operating condition, a purge operating condition, a shut down operating condition, a load operating condition, a no load operating condition, a base load operating condition, and a cool down operating condition.

According to another aspect of the present invention, the control unit is further configured to determine whether the current clearance of the current clearance of the gas turbine is within a predetermined clearance threshold. According to another aspect of the present invention, the control unit is further configured to take a control action if the current clearance is outside of the predetermined clearance threshold. According to yet another aspect of the present invention, the control action includes one or more of shutting off the gas turbine, setting off an alarm, or transmitting an alarm message.

According to another aspect of the invention, the control unit is further configured to determine whether the gas turbine may be ignited based on the current clearance of the gas turbine.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1A:
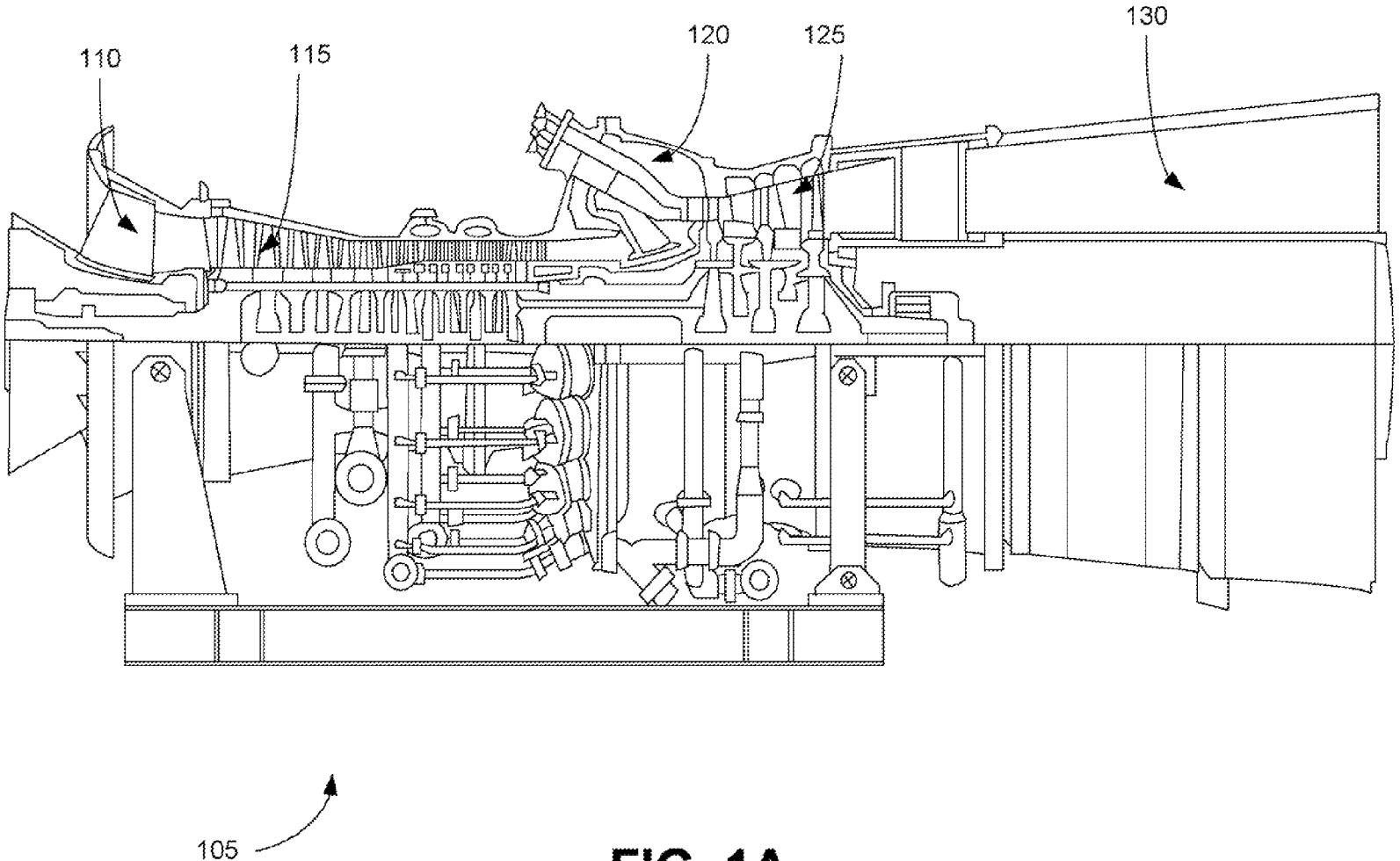
FIG. 1A illustrates a longitudinal cross-sectional view of an exemplary embodiment of a gas turbine that may be used in accordance with the clearance control system of the present invention.

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention is described below with reference to block diagrams of systems, methods, apparatuses and computer program products according to an embodiment of the invention. It will be understood that each block of the block diagrams, and combinations of blocks in the block diagrams, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functionality of each block of the block diagrams, or combinations of blocks in the block diagrams discussed in detail in the descriptions below.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the block or blocks.

Accordingly, blocks of the block diagrams support combinations of means for performing the specified functions, combinations of steps for performing the specified functions and program instruction means for performing the specified functions. It will also be understood that each block of the block diagrams, and combinations of blocks in the block diagrams, can be implemented by special purpose hardware-based computer systems that perform the specified functions or steps, or combinations of special purpose hardware and computer instructions.

The inventions may be implemented through an application program running on an operating system of a computer. The inventions also may be practiced with other computer system configurations, including hand-held devices, multiprocessor systems, microprocessor based or programmable consumer electronics, mini-computers, mainframe computers, etc.

Application programs that are components of the invention may include routines, programs, components, data structures, etc. that implement certain abstract data types, perform certain tasks, actions, or tasks. In a distributed computing environment, the application program (in whole or in part) may be located in local memory, or in other storage. In addition, or in the alternative, the application program (in whole or in part) may be located in remote memory or in storage to allow for the practice of the inventions where tasks are performed by remote processing devices linked through a communications network. Exemplary embodiments of the present invention will hereinafter be described with reference to the figures, in which like numerals indicate like elements throughout the several drawings.

According to an aspect of the present invention, a method for determining parameter limit exceedance incorporates both the allowable magnitude of a parameter and the rate of change of the parameter into one simple method. The total absolute change of the magnitude of a parameter is monitored over a time interval. The total magnitude change is then compared to a predefined limit curve to determine whether any parameter limits have been exceeded. If limits have been exceeded, the system will take corrective action.

FIG. 1A illustrates an exemplary embodiment of a gas turbine 105 that may be used in accordance with the clearance control system 500 of the present invention. The clearance control system 500 is described in greater detail below with reference to FIG. 5. The gas turbine 105 shown in FIG. 1A is a heavy duty gas turbine utilized in a power plant; however, it will be understood that by those of skill in the art that the present invention may be utilized with any other turbine capable of extracting energy from a flow of combustion gas such as an aircraft gas turbine. The gas turbine 105 may include an intake 110, a compressor section 115, a combustor section 120, a turbine section 125, and an exhaust 130.

In operation, air may flow into the gas turbine 105 through the intake 110 and enter the compressor section 115 where it is compressed. Compressed air may then be channeled to the combustor section 120 where it may be mixed with fuel and ignited. The expanding hot gases from the combustor section 120 may drive the turbine section 125 and then exit the turbine through the exhaust 130. Additionally, in some embodiments, exhaust gases from the gas turbine 105 may be supplied to a heat recovery steam generator (not shown) that generates steam for driving one or more steam turbines (not shown).

Figure 1B:
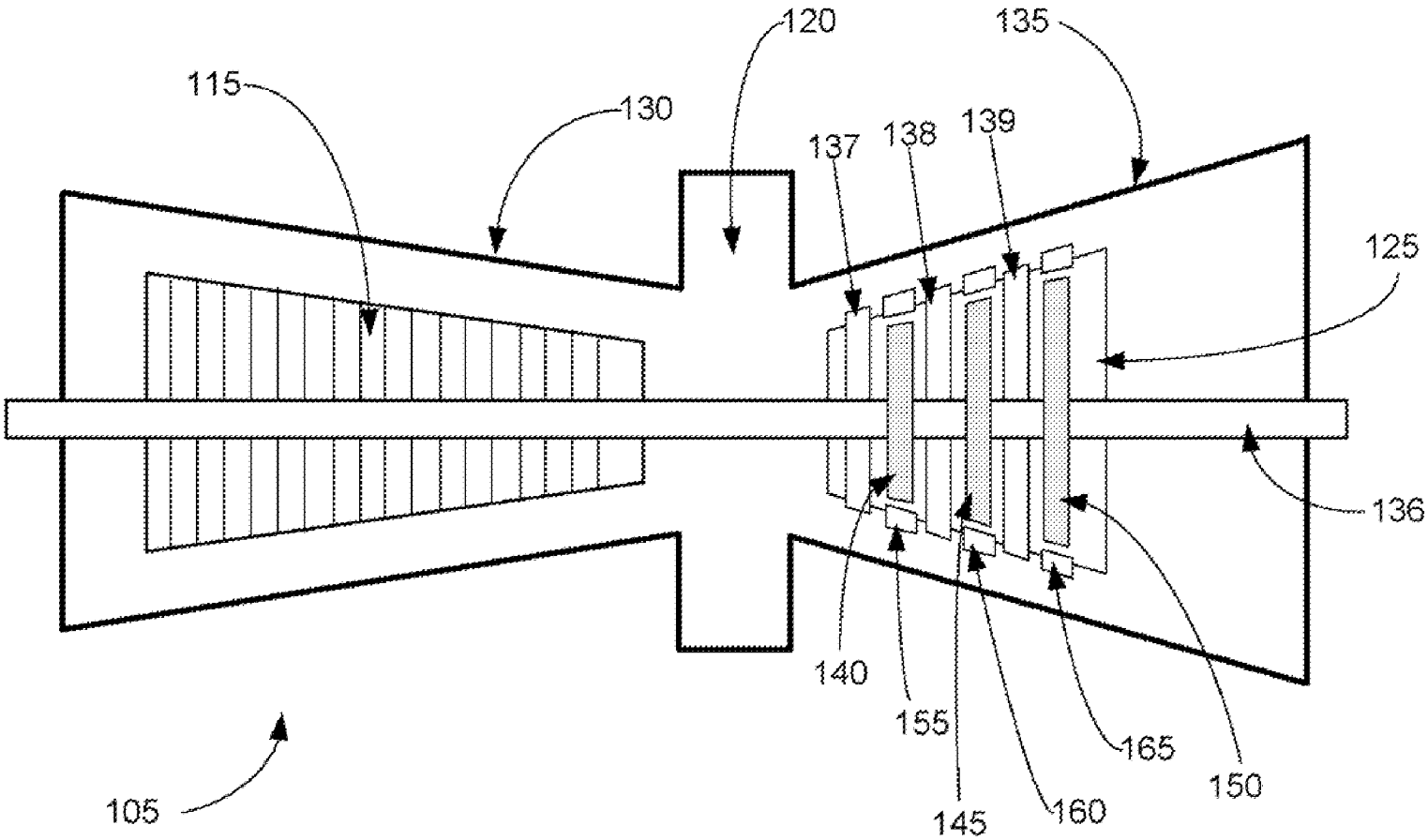
FIG. 1B is a cross-sectional diagram of a gas turbine that may be used in accordance with the clearance control system of the present invention.

FIG. 1B is a cross-sectional diagram of a gas turbine 105 that may be used in accordance with a clearance control system in accordance with the present invention. As shown in FIG. 1B, the gas turbine 105 may also include a compressor casing 130 and a turbine casing 135. The compressor and turbine casings 130, 135 enclose major parts of the gas turbine 105. For example, the turbine casing 135 may enclose the major parts of the turbine section 125 of the gas turbine 105 and the compressor casing 120 may enclose the major parts of the compressor section 115 of the gas turbine 105.

As also shown in FIG. 1B, the turbine section 125 may include a shaft 136 and a plurality of sets of rotating and stationary turbine blades. In operation, the expanding hot gases from the combustor section 120 may be directed by the stationary turbine blades, which are also referred to as stators or nozzles 137, 138, 139, and may drive the rotating turbine blades or rotor blades 140, 145, 150. The nozzles 137, 138, 139 may be affixed to the interior surface of the turbine casing 135 and may extend inwardly into the gas turbine 105. Additionally, the shaft 136 and rotor blades 140, 145, 150 may collectively be referred to as a rotor assembly. The gas turbine 105 of FIG. 1B shows three sets of nozzles and rotor blades; however, it will be understood by those of skill in the art that any number of sets of nozzles and rotor blades may be present in a gas turbine 105 used in accordance with the present invention.

It will further be understood that each set of nozzles and rotor blades may be referred to as a stage of the gas turbine 105. For example, as shown in FIG. 1B, the first nozzle 137 and rotor blade 140 may be referred to as the first stage of the gas turbine 105; the second nozzle 138 and rotor blade 145 may be referred to as the second stage of the gas turbine 105; and the third nozzle 139 and rotor blade 150 may be referred to as the third stage of the gas turbine 105. A gas turbine 105 used in accordance with the present invention may include any number of stages.

Figure 3:
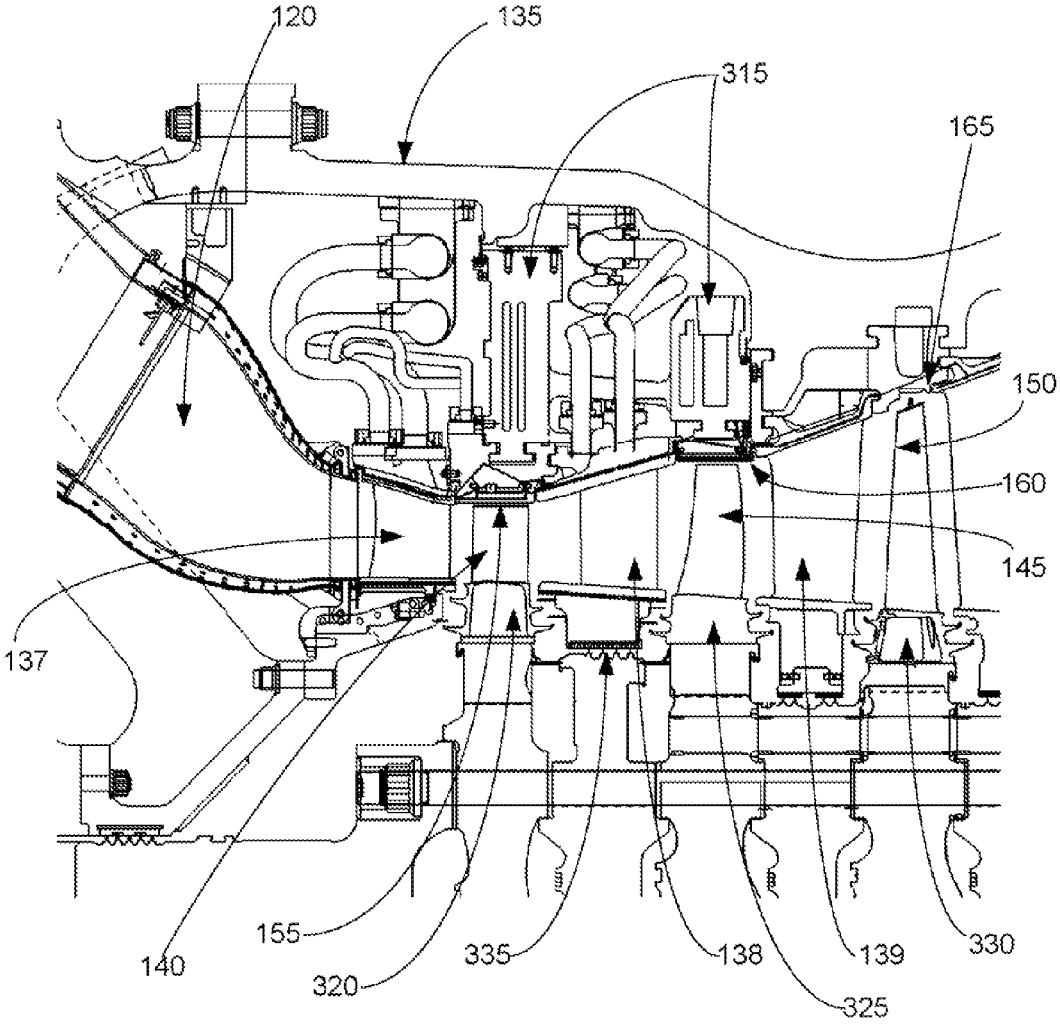
FIG. 3 is a cross-sectional view of the turbine section of a gas turbine that may be used in accordance with the clearance control system of the present invention.

It will also be understood that in some embodiments, the rotor blades 140, 145, 150 may be referred to as buckets. Alternatively, the term bucket may be used to describe both the exposed portion of a blade extending from the shaft 136 and the portion of the blade extending into the shaft 136. In such a situation, the term rotor blade is used to describe the exposed portion of the bucket. For the purposes of this disclosure, the term bucket is used to refer to an entire blade including both the exposed portion of a blade and the portion of a blade extending into the shaft 136, or the blade shaft portion as shown in FIG. 3. The term rotor blade is used to refer to the exposed portion of a blade or bucket. Regardless of the terminology used, the bucket tip and the rotor blade tip are the same.

The turbine casing 135 may also include one or more shrouds 155, 160, 165 affixed to the interior surface of the casing 135. The one or more shrouds 155, 160, 165 may be positioned proximate to the tips of the rotor blades 140, 145, 150 of the gas turbine 105 in order to minimize gas leakage past the tips of the rotor blades 140, 145, 150. As shown in FIG. 1B, a stage one shroud 155 may be positioned proximate to the tip of the first stage rotor blade 140, a stage two shroud 160 may be positioned proximate to the tip of the second stage rotor blade 145, and a stage three shroud 165 may be positioned proximate to the tip of the third stage rotor blade 150. The one or more shrouds 155, 160, 165 may be separate from one another as shown in FIG. 1B or, alternatively, the one or more shrouds 155, 160, 165 may be linked or joined together along their edges. In operation, the one or more shrouds 155, 160, 165 may assist in directing the gas flow in the turbine section 125 onto the rotor blades 140, 145, 150, thereby increasing damping and reducing blade or rotor flutter in the gas turbine 105.

Figure 2:
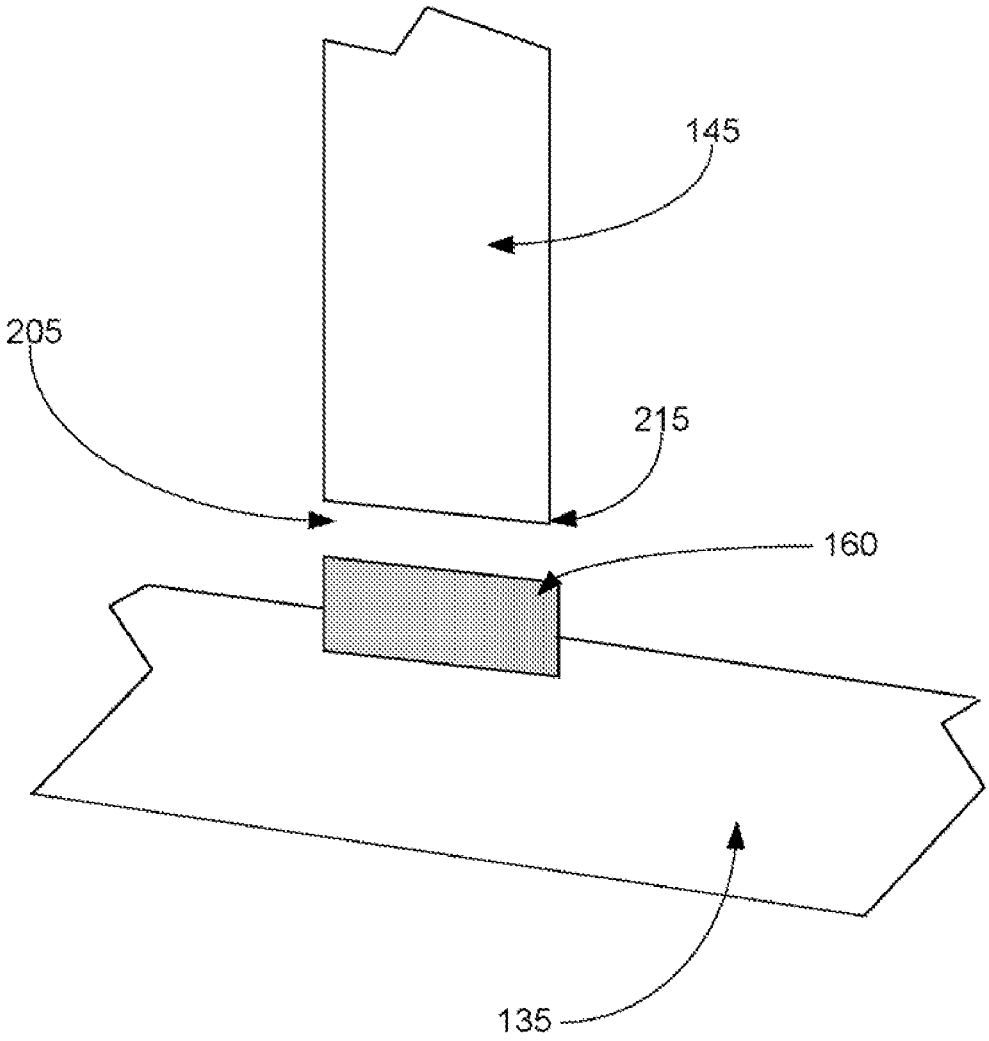
FIG. 2 is a schematic view of a gas turbine clearance that may be monitored by a clearance control system, in accordance with an illustrative embodiment of the present invention.

FIG. 2 is a schematic view of the clearance 205 of a gas turbine 105 that may be monitored and controlled by a clearance control system 500 in accordance with the present invention. A key contributor in the efficiency of a gas turbine 105 may be the amount of air or other gas flow that leaks through the separation between the rotor blades 140, 145, 150 and the one or more shrouds 155, 160, 165. It will be appreciated that, if a gas turbine 105 does not include one or more shrouds, the leakage may occur through the separation between the rotor blades 140, 145, 150 and the turbine casing 135. As shown in FIG. 2, the area between a rotor blade 145 and its corresponding shroud 160 may be referred to as the clearance 205. While FIG. 2 illustrates the clearance 205 between the second stage rotor blade 145 and the stage two shroud 160, it will be appreciated by those skilled in the art that other clearances in the gas turbine 105 may be monitored and controlled by the clearance control system 500 of the present invention.

Due to the different thermal growth characteristics of the shaft 136, rotor blade 145, blade shaft portion 325 (shown in FIG. 3), and turbine casing 135 as the temperature in the turbine 105 rises, the clearance 205 between the rotor blade 145 and the turbine casing 135 may significantly change as the turbine 105 transitions through various stages of operation. For example, the clearance 205 of the turbine 105 operating at no load may be different from the clearance 205 of the turbine 105 operating at base load.

The clearance 205 of the gas turbine 105 may also be affected by the ambient temperature or other conditions of the environment in which the turbine 105 operates. For example, the clearance 205 of a turbine 105 operating in a cold environment may be less than the clearance 205 of a turbine 105 operating in a warm environment because the turbine casing 135 will not heat up as much and expand in the cold environment.

Additionally, the clearance 205 of a gas turbine 105 may be affected by the mechanical growth of the rotor blade 145 as the turbine 105 operates. During operation, as the rotor assembly is rotated, the rotor blade 145 may experience a mechanical growth due to rotational forces.

FIG. 3 is a cross-sectional view of the turbine section 125 of a gas turbine 105 that may be used in accordance with the clearance control system 500 of the present invention. Three stages of the turbine section 125 are shown in FIG. 3. The first stage rotor blade 140 may be part of a first stage bucket that also includes a first stage blade shall portion 320; the second stage rotor blade 145 may be part of a second stage bucket that also includes a second stage blade shaft portion 325; and the third stage rotor blade 150 may be part of a third stage bucket that also includes a third stage blade shaft portion 330.

Additionally, the turbine casing 135 of the gas turbine 105 may include an inner turbine shell or ITS 315. The stage one shroud 155 and stage two shroud 160 may be affixed to the inner surface of the ITS 315. The one or more nozzles 137, 138, 139 may also be included in the turbine section 125 of the gas turbine 105. For example, as shown in FIG. 3, the turbine 105 may include a stage one nozzle 137, a stage two nozzle 138, and a stage three nozzle 139. For each stage of the gas turbine 105, the corresponding nozzle may direct the flow of the expanding gases entering the gas turbine 105 from the combustor section 120 to the gas turbine rotor blades 140, 145, 150. For example, the stage two nozzle 138 may direct air into the second stage of the gas turbine 105 in order to cause the expanding gas from the combustor section 120 to flow onto the stage two rotor blade 145. The nozzles 137, 138, 139 may be situated adjacent to the shrouds 155, 160, 165 of the gas turbine 105, and the nozzles 137, 138, 139 may be affixed to or connected to the shrouds 155, 160, 165 of the gas turbine 105. Alternatively, the one or more nozzles 137, 138, 139 may be affixed to the internal surface of the turbine casing 135.

According to an aspect of the present invention, the growth of the ITS 315 may be controlled in order to control the clearances of the gas turbine 105. As shown in FIG. 3, the growth of the ITS 315 may be controlled in order to control the clearances of the stage one shroud 155, the stage two shroud 160, and the stage two nozzle 138. The clearance of the stage two nozzle 138 may be the separation between the shaft 136 and a stage two nozzle seal 335 located at the innermost side of the stage two nozzle 138 next to the shaft 136. In many gas turbine designs, it is beneficial to have no contact or rub in the first two stages of the gas turbine 105. In other words, it is beneficial for the first and second stage rotor blades 140, 145 to make no contact with the stage one shroud 155 and/or the stage two shroud 160, and it is beneficial for the stage two nozzle 138 to make no contact with the shaft 136. Accordingly, the present invention may be used to control at least the clearance of the first two stages of the gas turbine 105; however, it will be understood by those of skill in the art that the present invention may be used to control the clearances of other stages of the gas turbine 105.

Figure 4:
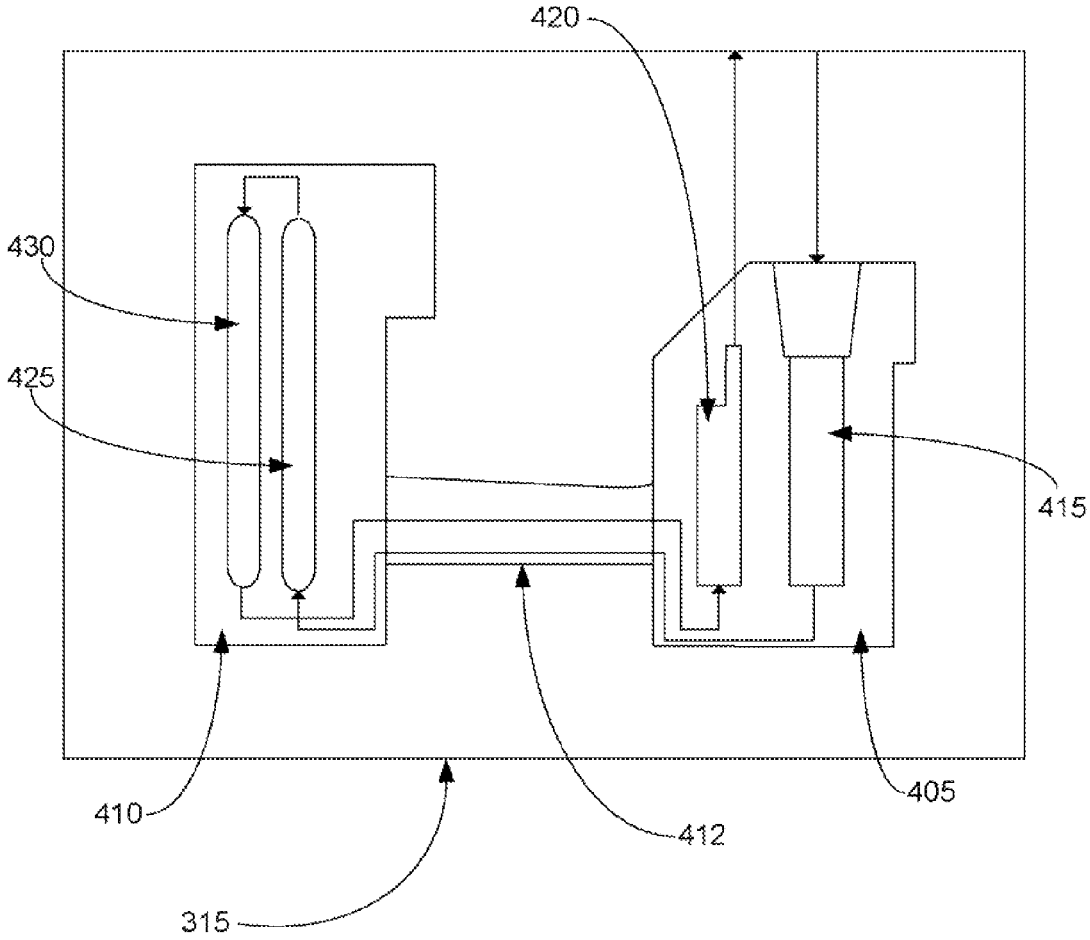
FIG. 4 is a schematic view of the inner turbine shell of a gas turbine that may be used in accordance with the clearance control system of the present invention.

FIG. 4 is a schematic diagram of an inner turbine shell 315 of a gas turbine 105 that may be used in accordance with the clearance control system 500 of the present invention. According to an aspect of the present invention, the inner turbine shell 315 may include one or more cavities or pockets through which air or some other gas may be circulated. The air circulated through the cavities of the ITS 315 may control the thermal growth of the ITS 315. For example, if warmer air is circulated through the ITS 315, then the ITS 315 may expand, leading to greater clearances in the gas turbine 105. Alternatively, if cooler air is circulated through the ITS 315, then the ITS 315 may contract or shrink, leading to smaller clearances in the gas turbine 105.

As shown in FIG. 4, the ITS 315 may include a first section 405 and a second section 410. A bridge 412 may connect the first and second sections 405, 410 of the ITS 315. The first section 405 may include a first cavity 415 and a second cavity 420, and the second section 410 may include a third cavity 425 and a fourth cavity 430. It will, however, be understood that the ITS 315 may include any number of sections and any number of cavities in those sections.

Additionally, each cavity 415, 420, 425, 430 may be connected to one or more of the other cavities 415, 420, 425, 430. The connections between the cavities 415, 420, 425, 430 may contribute to the flow of air through the ITS 315. As shown in FIG. 4, when air enters the ITS 315, it may be allowed to flow into the first cavity 415. The air will flow through the first cavity 415, across the bridge 412, and into the third cavity 425. The air will then flow through the third cavity 425 and into the fourth cavity 430. After the air flows through the fourth cavity 430, it will flow back across the bridge 412 and into the second cavity 420. After the air flows through the second cavity 420, it may be allowed to flow out of the ITS 315. It will be understood by those of skill in the art that air may be circulated through the ITS 315 in many different sequences other than that illustrated in FIG. 4.

Figure 5:
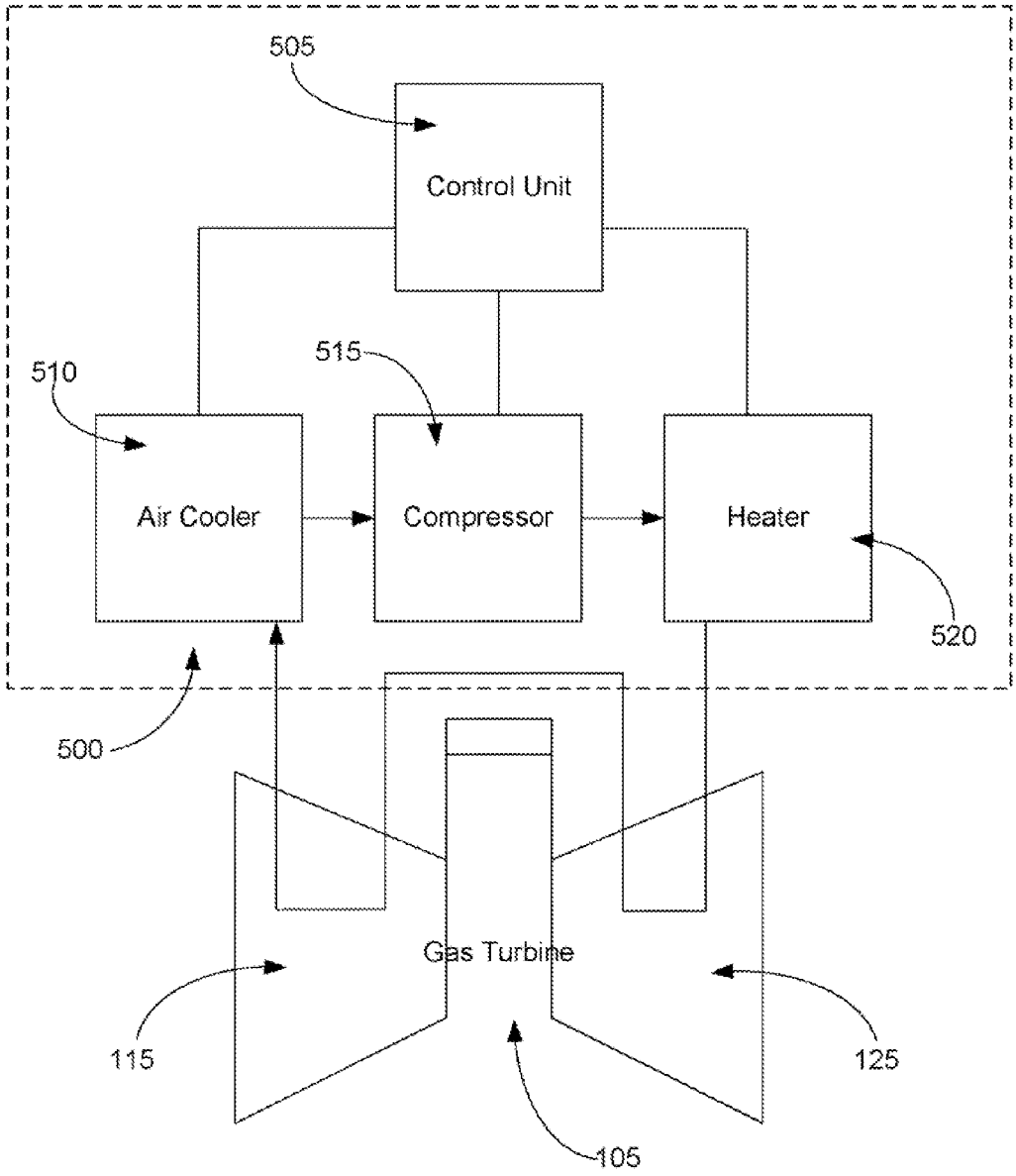
FIG. 5 is a block diagram of a clearance control system, according to an illustrative embodiment of the present invention.

FIG. 5 is a block diagram of a clearance control system 500 according to an illustrative embodiment of the present invention. The clearance control system 500 may include a control unit 505, an air cooler 510, a compressor 515, and a heater 520. The clearance control system 500 may be a closed-loop system. The control unit 505 may be in communication with the other components of the clearance control system 500, as well as external devices such as, for example, the gas turbine 105. Additionally, the control unit 505 may monitor the clearances in the gas turbine 105 and control the operation of the clearance control system 500 in order to maintain the clearances within a desired range. The air cooler 510 may be any suitable device for lowering the temperature of air or some other gas supplied to it such as, for example, a shell and tube heat exchanger that utilizes water as a coolant to lower or reduce the temperature of air or some other gas passed through the heat exchanger. The compressor 515 may be any suitable device for increasing the pressure of air or some other gas supplied to it such as, for example, a single-stage centrifugal compressor. The heater 520 may be any suitable device for raising the temperature of air or some other gas supplied to it such as, for example, an electric heater.

In operation, when air enters the clearance control system 500, it may be cooled by the air cooler 510 in order to meet inlet temperature limits of the compressor 515. The inlet temperature limit of the compressor 515 may be, for example, 350 degrees Fahrenheit; however, it will be understood that the compressor 515 may have many different inlet temperature limits. The air may then flow from the air cooler 510 to the compressor 515. The compressor 515 may increase the pressure of the air entering it, causing the air to circulate through the closed-loop clearance control system 500. Once the air exits the compressor 515, it may flow to the heater 520. The heater 520 may control the temperature of the air that is supplied to the ITS 315 of the turbine section 125 of the gas turbine 105. The combination of the air cooler 510 and the heater 520 may provide air at a desired temperature to the ITS 315. Air supplied to the ITS 315 may circulate through the cavities 415, 420, 425, 430 of the ITS 420, thereby controlling the thermal expansion of the ITS 315 and affecting the clearances of the gas turbine 105. If the air supplied to the ITS 315 is warmer than the temperature of the ITS 315, then the ITS 315 may expand, thereby increasing the clearances in the gas turbine 105. Alternatively, if the air supplied to the ITS 315 is cooler than the temperature of the ITS 315, then the ITS 315 may contract, thereby decreasing the clearances in the gas turbine 105.

After the air is circulated through the ITS 315, it may flow though the compressor casing 130 of the compressor section 115 of the gas turbine 105 in order to control the clearances of the compressor section 115. The clearances of the compressor section 115 of the gas turbine 105 may be controlled in the same manner as the clearances of the turbine section 125. After flowing through the compressor casing 130, the air may flow back to air cooler 510 of the clearance control system 500. It will be understood by those of skill in the art that the air may flow from the ITS 315 directly hack to the clearance control system 500. It will also be understood that a separate clearance control system 500 may control the clearances in the compressor section 115. If a separate clearance control system is used to control the clearances in the compressor section, the separate clearance control system may be controlled by a separate control unit or, alternatively, the separate clearance control system may be controlled by the same control unit 505 that monitors the turbine section 125 of the gas turbine 105.

According to an aspect of the present invention, the control unit 505 may monitor the clearances in the gas turbine 105 and control the temperature of the air that is circulated through the ITS 315 by the clearance control system 500. By controlling the temperature of the air circulated through the ITS 315, the control unit 505 may control the clearances within the gas turbine 105. Beneficially, the control unit 505 may maintain the clearances within the gas turbine 105 at a minimum value in order to increase the efficiency of the gas turbine 105.

Additionally, the control unit 505 may monitor various parameters of the gas turbine 105 in order to control the clearances of the gas turbine 105. Parameters that may be monitored by the control unit 505 include, but are not limited to, the ambient temperature in which the gas turbine 105 is operating, the cycle, load or firing temperature condition of the gas turbine 105, the temperature of the nozzles 137, 138, 139, and the temperature of the rotor blades 140, 145, 150. Measurement data associated with the parameters of the gas turbine 105 may be supplied to the control unit 505 by appropriate measurement devices. For example, a temperature measurement device may continually monitor the bulk temperature of a nozzle 137 of the gas turbine 105 and communicate those measurements to the control unit 505. Similarly, temperature measurement devices may be used to take temperature measurements of other components of the gas turbine 105 or of the ambient conditions in which the gas turbine 105 operates. Suitable temperature measurement devices may include, but are not limited to, thermocouple temperature measurement sensors (or thermocouplers), bimetallic temperature measurement devices, or thermometers. Additionally, the control unit 505 may utilize the temperature measurements of one component of the gas turbine 105 to calculate the temperature of one or more of the other components of the gas turbine 105. For example, as explained in greater detail below, the control unit 105 may utilize temperature measurements of one or more of the nozzles or stators 137, 138, 139 and temperature measurements of the turbine casing 135 of the gas turbine 105 in order to calculate the average or bulk temperature of one or more of the rotor blades 140, 145, 150 of the gas turbine 105.

According to another aspect of the present invention, the control unit 505 may monitor the clearances in the gas turbine 105 by determining the mechanical and thermal growth of one or more of the components of the gas turbine 105, as described in greater detail below with reference to FIG. 7. The control unit 505 may utilize the various temperature, measurements supplied to it in determining the mechanical and thermal growth of the one or more components of the gas turbine 105. The control unit 505 may then use any determined mechanical and thermal growths in order to determine the current clearances in the gas turbine 105. For example, the control unit 505 may determine the mechanical and thermal growths of the shaft 136, rotor blade 145, and shroud 160 of the gas turbine 105. The control unit 505 may then subtract these growths from a predefined clearance of the gas turbine 105 to determine the current clearance of the second stage of the gas turbine 105.

According to yet another aspect of the present invention, the control unit 505 may monitor and control the clearances in the gas turbine 105 though all of the cycle and or load conditions of the gas turbine 105. For example, the control unit 505 may monitor and control the clearances in the gas turbine 105 from the time that the gas turbine 105 is first started or fired until the gas turbine 105 reaches a full or base load condition. The control unit 505 may also monitor and control the clearances in the gas turbine 105 during a shut down or unloading condition of the gas turbine 105.

Figure 6:
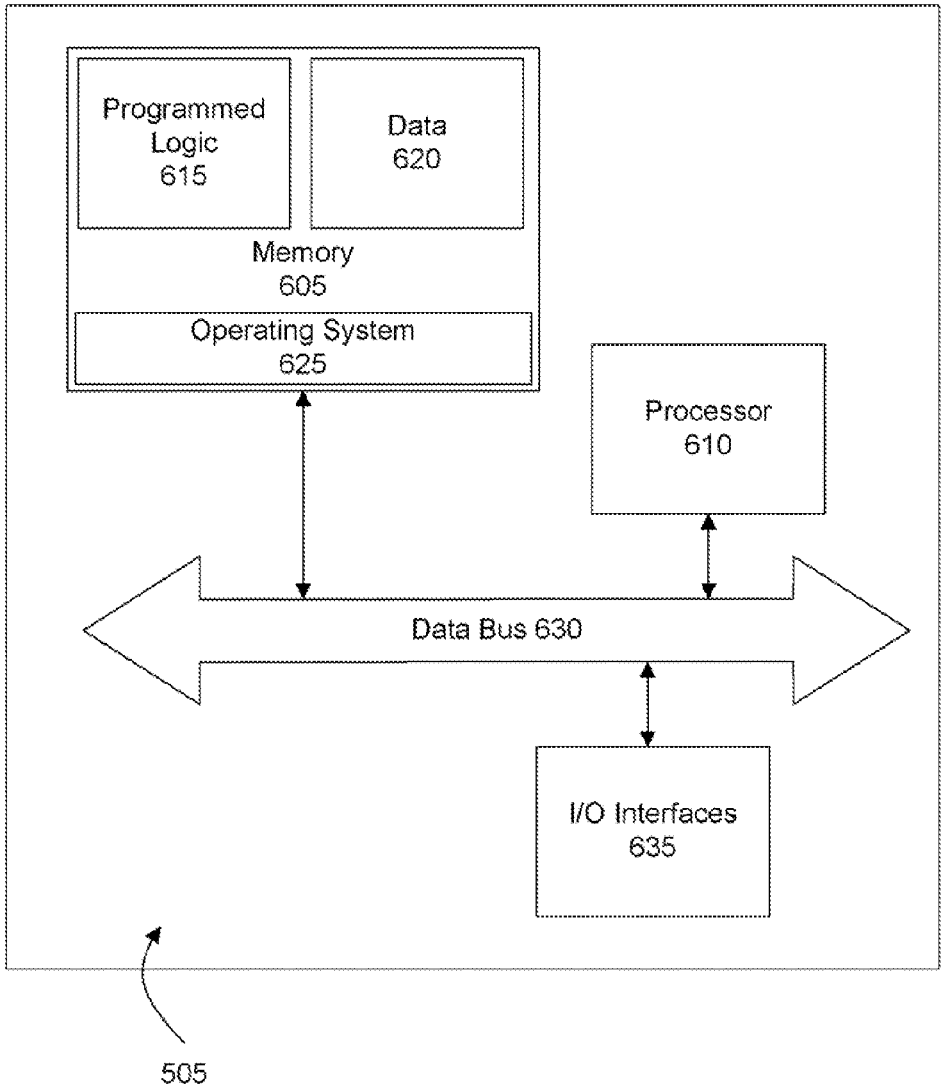
FIG. 6 is a block diagram of a control unit used in a clearance control system, according to an illustrative embodiment of the present invention.

FIG. 6 is a block diagram of a control unit 505 that may be associated with a clearance control system 500 according to the present invention. The control unit 505 may include a memory 605 and a processor 610. The memory may store programmed logic 615 (e.g., software code) in accordance with the present invention. The memory 605 may also include measurement data 620 utilized in the operation of the present invention and an operating system 625. The processor 610 utilizes the operating system 625 to execute the programmed logic 615, and in doing so, also utilizes the measurement data 620. The programmed logic 615 may include the logic associated with operation of the clearance control system 500, as illustratively provided for in FIGS. 7-8. A data bus 630 may provide communication between the memory 605 and the processor 610. The control unit 505 may be in communication with the other components of the clearance control system 500 and perhaps other external devices, such as keyboards or other user interface devices, via an I/O Interface 635. The control unit 505 may also receive measurement data from the various measurement devices via the I/O Interface 635. Further, the control unit 505 and the programmed logic 615 implemented thereby may comprise software, hardware, firmware or any combination thereof.

Figure 7:
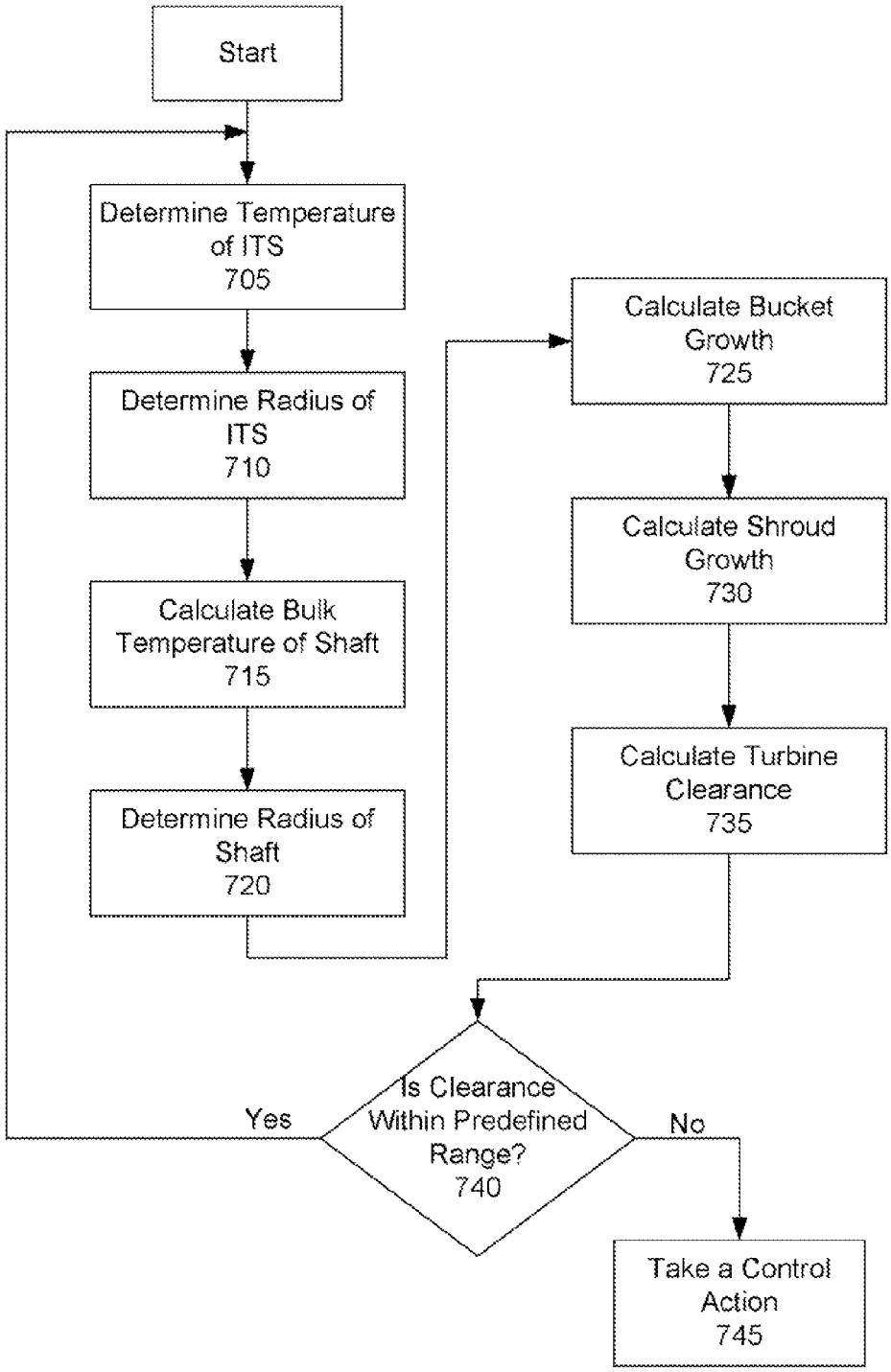
FIGS. 7-8 are exemplary flowcharts of the control logic used by the control unit of FIG. 6, according to an illustrative embodiment of the present invention.

FIG. 7 is an exemplary flow chart of the basic control logic of the control unit 505 of the clearance control system 500, according to an illustrative embodiment of the present invention. The control logic described in FIG. 7 is applicable to one stage of the turbine section 125 of the gas turbine 105; however, it will be understood that the control unit 505 may utilize similar logic to control the clearance for any stage of the turbine section 125. Once the control unit 505 starts, it goes to step 705 and determines the temperature of the nozzle 138, ITS 315, and/or turbine casing 135 of the gas turbine 105. These temperature measurements may be provided to the control unit 505 by one or more suitable temperature measurement device associated with the gas turbine 105, as described above. For purposes of this disclosure, the temperature measurement determined by the control unit 505 in step 705 is the current temperature of the ITS 315; however, it will be understood by those of ordinary skill in the art that other temperature measurements may be taken into account by the control unit 505 in accordance with the present invention.

Once the control unit 505 determines the temperature of the ITS 315 at step 705, then the control unit 505 goes to step 710. At step 710, the control unit 505 calculates the radius of the ITS 315. The radius is calculated by adding the amount of thermal growth of the ITS 315 to the initial radius of the ITS 315. For example, the initial radius of the ITS 315 is the radius of the ITS 315 when the gas turbine 105 is not operating and uniformly at a reference temperature. The value of the initial radius of the ITS 315 may be a known value stored in the memory 605 of the control unit 505, and the thermal growth of the ITS 315 may be a function of the temperature of the ITS 315. At step 710, the control unit 505 may utilize the measured temperature of the ITS 315 to calculate the thermal growth of the ITS 315 and may then add that value to the initial radius of the ITS 315 to calculate the current radius of the ITS 315. Once the current radius of the ITS 315 is calculated at step 710, then the control unit 505 may go to step 715.

At step 715, the control unit 505 may calculate the bulk or average temperature of the shaft 136. According to an aspect of the present invention, the control unit 505 may calculate the bulk temperature of the shaft 136 by utilizing a predefined model or equation for the gas turbine 105. The predefined model may predict the current bulk temperature of the shaft 136 for different times during each cycle or load condition of the gas turbine 105. It will be understood by those of skill in the art that many different predefined models for the bulk temperature of the shaft 136 may be utilized in accordance with the present invention. For example, the model may be a model determined by a telemetry system that monitors the gas turbine 105 throughout all of the stages of the gas turbine's 105 operation. Additionally, in generating the model, the telemetry system may be used to measure the surface temperature at various locations on the shaft 136, and the surface measurements may be averaged and compared to predicted surface and bulk temperatures of the shaft 136. Accordingly, a model or equation for predicting the bulk temperature of the shaft 136 may be determined for each cycle or load condition of the gas turbine 105. An exemplary equation for predicting the bulk temperature of the shaft 136 may take the form of equation (1) below:

$$\frac{T(t) - T_{i,1}}{T_{ss,FSNL} - T_{i,1}} = 1 - \exp\left[\frac{-(t - t_{offset,1})}{tao_1}\right] \quad (1)$$

where T(t) is the bulk temperature of the shaft 136 at time t, $T_{i,1}$ is the initial temperature of the shaft 136, $T_{ss,FSNL}$ is the temperature of the shaft 136 at a steady state full speed, no load condition of the gas turbine 105, and $t_{offset,1}$ and $tao_1$ are constants. The above equation may be used to calculate the bulk temperature of the shaft 136 while the gas turbine 105 is transitioning between an initial firing condition to a full speed, no load condition. A full speed, no load condition exists when the shaft 136 and/or rotor blades 145, 150, 155 of the gas turbine 105 have reached their maximum rotational velocity (i.e., 3000 revolutions per minute) prior to firing the turbine 105, but the turbine 105 has not yet been loaded. Whereas the equation above is exemplary of a model for calculating the bulk temperature of the shaft 136 when the gas turbine 105 if transitioning from an initial firing condition to a full speed, no load condition, it will be understood by those of skill in the art that similar equations using different constants and starting conditions may be developed for the other cycle and load conditions of the gas turbine 105. For example, different equations may be developed for the turbine 105 transitioning from a full speed, no load condition to a full speed, full load (or bulk load) condition, for slow, unfired rotation of the gas turbine 105, for fast, unfired rotation of the gas turbine 105 when the gas turbine 105 is being started, for shutting down the gears of the gas turbine 105, and for shutting down the crank of the gas turbine 105. For the two listed shut down conditions of the gas turbine 105, the initial temperature may be the ambient temperature of the environment in which the gas turbine 105 is operating.

At step 715, the control unit 505 may utilize the current cycle and load condition of the gas turbine 105, the current time, and, where applicable, the current ambient temperature to calculate the current bulk temperature of the shaft 136 according to the predefined model or equation. It will be understood by those of skill in the art, however, that the control unit 505 may utilize other methods for calculating the bulk temperature of the shaft 136. For example, the control unit 505 may receive direct measurements of the temperature of the shaft 136 from suitable measurement devices. Alternatively, the control unit 505 may compare the current temperature of the ITS 315 to predicted surface and bulk temperatures of the shaft 136. When the current temperature of the ITS 315 is approximately equal to the predicted surface temperature of the shaft 136, the control unit 505 may assume that the current bulk temperature of the shaft 136 is the corresponding bulk temperature for the surface temperature.

After the current bulk temperature of the shaft 136 is calculated at step 715, then the control unit 505 goes to step 720 and calculates the radius of the shaft 136. The radius of the shaft 136 is calculated by adding the amount of thermal and/or mechanical growth of the shaft 136 to the initial radius of the shaft 136. The initial radius may be the radius of the shaft 136 when the gas turbine 105 is not operating and is uniformly at a reference temperature. The value of the initial radius may be a known value stored in the memory 605 of the control unit 505, and the thermal and/or mechanical growth of the shaft 136 may be a function of the temperature of the shaft 136. At step 720, the control unit 505 may utilize the calculated bulk temperature of the shaft 136 to calculate the thermal growth of the shaft 136. Additionally, the control unit 505 may utilize the current temperature of the shaft 136, the current cycle or load condition of the gas turbine 105, and the current rotational velocity of the shaft 136 to calculate the mechanical growth of the shaft 136. The calculated thermal and mechanical growths may then be added to the value of the initial radius of the shaft to calculate the current radius of the shaft 136. Once the current radius of the shaft 136 is calculated at step 720, then the control unit 505 may go to step 725.

At step 725, the control unit 505 may calculate the growth of the bucket attached to the shaft 136. The bucket may include both the rotor blade 145 and the blade shaft portion 325. Once the growth of the bucket has been calculated at step 725, the control unit 505 may go to step 730 and calculate the growth of the corresponding shroud 160 for the rotor blade 145. Both the bucket growth and the shroud growth are a function of the current temperature inside the turbine section 125 of the gas turbine 105, or the current firing temperature. The bucket growth and the shroud growth may be calculated by the control unit 505 by utilizing similar methods, which will be described herein with reference to the bucket growth.

An exemplary method for calculating the bucket growth may be to determine the current bucket growth relative to the full speed, no load condition of the gas turbine. The bucket growth may be a constant value at both a full speed, no load condition and at a full speed, full load condition. The bucket growth at a full speed, no load condition may be represented by the variable A, and the bucket growth at a full speed, full load condition may be represented by the variable B. Any bucket growth occurring between these two conditions may be calculated by the control unit 505 by utilizing equation (2) below:

$$\text{Growth} = A + \left[C * \left[\frac{T(t) - T_{FSNL}}{T_{FSFL} - T_{FSNL}}\right]\right] \tag{2}$$

where C is a constant equal to B−A, T(t) is the current firing temperature, $T_{FSNL}$ is the firing temperature at a full speed, no load condition, and $T_{FSFL}$ is the firing temperature at a full speed, full load condition. It will be understood that the shroud growth may be calculated by using the same or a similar methodology. It will also be understood that the bucket growth and the shroud growth may be calculated by using the methodology described above in conjunction with determining the growth of the shaft 136.

Once the bucket and shroud growth are calculated by the control unit 505, the control unit 505 may go to step 735 where it calculates the current clearance 205 of the rotor blade 145 in the gas turbine 105. The current clearance 205 is the separation between the tip 215 of the rotor blade 145 and the corresponding shroud 160 for that rotor blade 145. The total radius of the shaft 136 and bucket may be calculated by adding the radius of the shaft 136 calculated in step 720 to the initial radius of the buckets and the growth of the buckets. The radius enclosed by the turbine casing 135 may be calculated by subtracting the shroud growth and initial shroud radius from the initial radius of the area enclosed by the turbine casing 135, which is also the initial clearance of the gas turbine 105. The initial clearance of the gas turbine 105 may be a predefined value stored in the memory 605 of the control unit 505. Additionally, the growth or expansion of the ITS 315 may be considered by the control unit 505 when the current clearance is calculated. If the ITS 315 has been contracted by the clearance control system 500, then the amount of the contraction will be subtracted from the initial radius of the area enclosed by the turbine casing 135. Alternatively, if the ITS 315 has been expanded by the clearance control system 500, then the amount of the expansion may be added to the initial radius of the area enclosed by the turbine casing 135 in calculating the current clearance.

Once the current clearance 205 has been calculated at step 735, the control unit 505 goes to step 740. At step 740, the control unit 505 determines whether or not the current clearance 205 is within a predefined range of acceptable clearances. The acceptable range of clearances may be established by the user of the present invention. Additionally, the acceptable range of clearances may vary with the cycle and load conditions of the gas turbine 105. For example, the acceptable range of clearances within the gas turbine 105 may be approximately 0.04 to 0.08 inches; however, it will be understood by those of skill in the art that an acceptable clearance may be any positive clearance. If the current clearance 205 is within the acceptable predefined range of clearances, then the control unit 505 may return to step 705 and continue to calculate and monitor the clearance. If, however, the current clearance 205 is not within a predefined range, then the control unit 505 may go to step 745.

At step 745, the control unit 505 may take any appropriate control action. Appropriate control actions may include, but are not limited to, one or more of shutting off the gas turbine 105, setting off an alarm, transmitting an alarm message, or altering the temperature of the air circulating through the ITS 315 in order to change the clearance 205. If the control action involves altering the temperature of the air circulating through the ITS 315, then the control unit 505 may actuate or adjust the outputs of the air cooler 510, compressor 515, and/or heater 520, as described above with reference to FIG. 5. By continuously monitoring the clearance with the gas turbine 105, the clearance control system 500 may assist in preventing any contact between the buckets 210 and the shroud 160 or turbine casing 135.

It also will be understood by those of skill in the art that the steps performed by the control unit 505 during its general operation do not necessarily have to be performed in the order set forth in the logic of FIG. 7, but instead may be performed in any suitable order.

Figure 8:
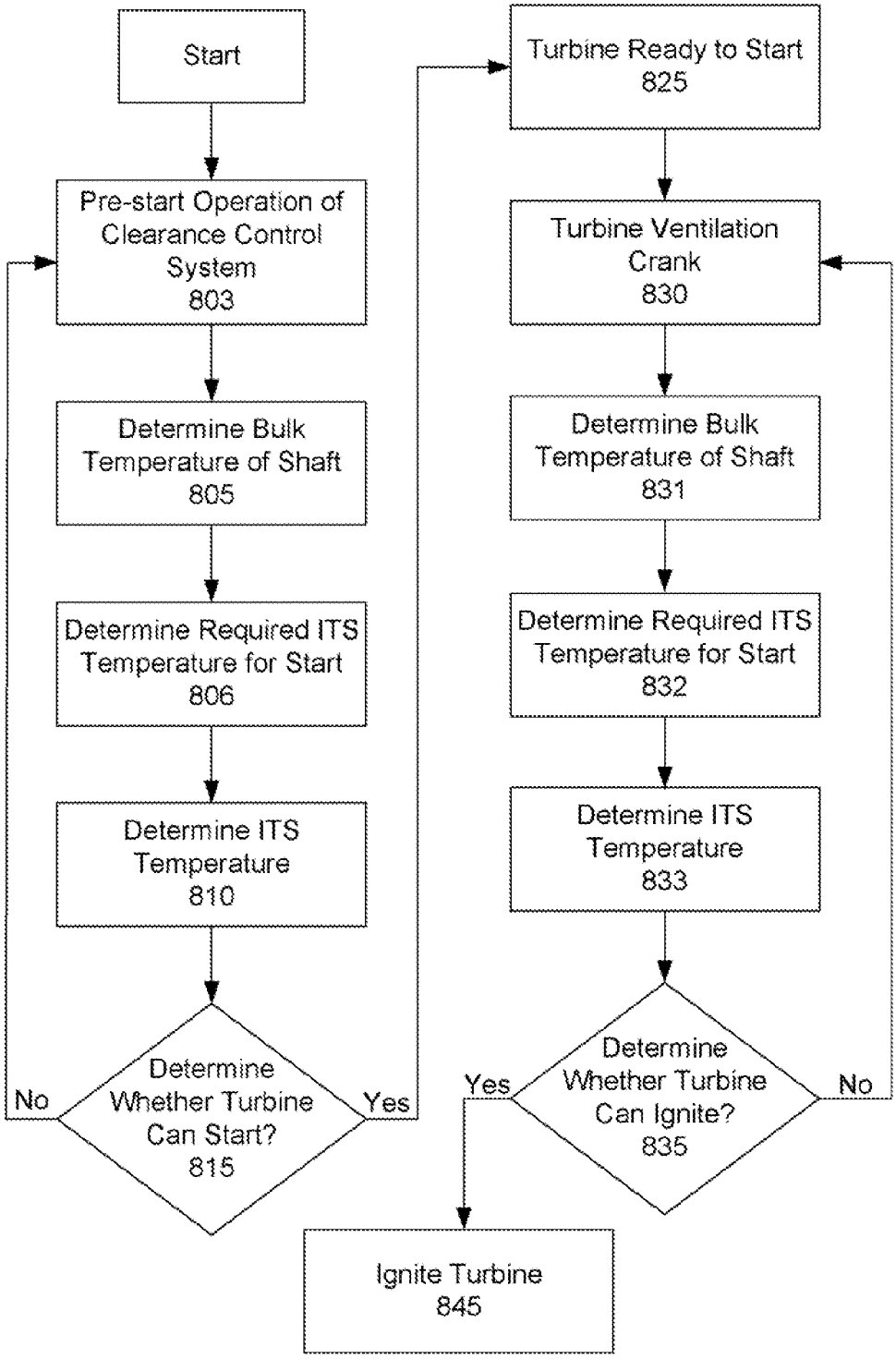

FIG. 8 is an exemplary flow chart of the logic utilized by the control unit 505 in determining whether a gas turbine 105 may be fired or ignited, according to an illustrative embodiment of the present invention. In addition to monitoring the clearance of the gas turbine 105 while the turbine 105 is operating, the clearance control system 500 of the present invention may also determine whether or not the gas turbine 105 may be started or ignited in the first place. During this determination, the control unit 505 may determine whether or not the clearance of the turbine 105 is sufficient for the turbine 105 to be started or ignited. During a normal start sequence of the gas turbine 105, the shaft 136 of the gas turbine 105 may be initially slowly rotated using a turning gear. The clearance control system 500 may monitor the gas turbine 105 during the start sequence and determine whether or not the gas turbine 105 may be ignited.

With reference to FIG. 8, prior to a gas turbine 105 entering an initial start sequence, the control unit 505 may enter step 803. At step 803, the control unit 505 may open up the clearance as much as possible by circulating heated air through the ITS 315. After the clearance control system being started at step 803, the control unit 505 may go to step 805.

At step 805, the control unit 505 may determine the temperature of the shaft 136. The temperature of the shaft 136 may be determined in the same manner as that described above with reference to FIG. 7. After the temperature of the shaft 136 is determined at step 805, the control unit 505 may go to step 806 and determine the minimum required temperature of the ITS 315 needed in order to permit the turbine 105 to be started. The minimum required temperature of the ITS 315 needed to permit the turbine 105 to be started may be a predetermined value that is a function of the temperature of the shaft 136. The minimum required temperature of the ITS 315 may also ensure that the clearance 205 remains above a minimum threshold value during the starting or ignition of the gas turbine 105.

After the minimum required temperature of the ITS 315 is determined at step 806, the control unit 505 may go to step 810. At step 810, the control unit 505 determines the current temperature of the ITS 315. The current temperature of the ITS 315 may be measured by a suitable measurement device such as, for example, a thermocouple measuring device and then communicated to the control unit 505. After the temperature of ITS 315 is determined at step 810, then the control unit 505 may go to step 815.

At step 815, the control unit 505 may determine whether or not the gas turbine 105 may be started by determining whether the current temperature of the ITS 315 exceeds the required minimum temperature of the ITS 315. If, at step 815, the control unit 505 determines that the gas turbine 105 may not be started, then the control unit 505 returns to step 803. It will be understood by those of skill in the art that the control unit 505 may also take actions in addition to or as an alternative to returning to step 803. The control unit 505 may, for example, set off an alarm or transfer an alarm message indicating that the temperature of the ITS 315 is not sufficient to allow the gas turbine 105 to be started, or the control unit 505 may shut down the gas turbine 105.

If, however, at step 815, the control unit 505 determines that the gas turbine 105 may be started, then the control unit 505 goes to step 825. Step 825 is a ready to start state for the gas turbine 105. At step 825, a start sequence for the gas turbine 105 may be initiated by either the control unit 505 or by an operator of the gas turbine 105. After the start sequence has been initiated, then the control unit 505 may go to step 830.

At step 830, the combustion section 120 of the gas turbine 105 may ventilate the gas turbine 105 with air in order to clear or expel any flammable or explosive gases from the gas turbine 105 and any associated downstream exhaust ducting. Step 830 may also be referred to as ventilation cranking of the gas turbine 105. If flammable or explosive gases are present when the gas turbine 105 is ignited, an explosion might occur within the gas turbine 105.

Once the gas turbine 105 has been ventilated at step 830, the control unit 505 goes to step 831. The temperature of the turbine casing 135, ITS 315 and/or the temperature of the shaft 136 may be altered by the ventilation of the gas turbine 105, leading to a different turbine clearance. Accordingly, in steps 831-835, the control unit 505 once again determines the temperatures of the shaft 831 and ITS 315 and then determines whether or not the gas turbine 105 may be ignited. At step 831, the control unit 505 may once again determine the temperature of the shaft 136 in the same manner as that described above with reference to FIG. 7. After the temperature of the shaft 136 is determined at step 831, then the control unit 505 may go to step 832. At step 832, the control unit 505 may once again calculate the minimum required temperature of the ITS 315 necessary for ignition of the gas turbine 105. The minimum required temperature of the ITS 315 necessary for ignition of the gas turbine may be a predetermined value that is a function of the temperature of the shaft 136. The minimum required temperature of the ITS 315 necessary for ignition of the gas turbine 105 may be the same value as the minimum required temperature of the ITS 315 necessary for starting the gas turbine 105 or, alternatively, it may be a different value. Unlike the minimum required temperature of the ITS 315 necessary for starting the gas turbine 105, the minimum required temperature of the ITS 315 necessary for ignition of the gas turbine 105 need not account for any temperature loss due to ventilation of the gas turbine 105.

After the required temperature of the ITS 315 for ignition has been determined at step 832, then the control unit 505 goes to step 833. At step 833, the control unit 505 may determine the current temperature of the ITS 315 as that described above with reference to step 810. After the current temperature of the ITS 315 is determined at step 833, then the control unit 505 may go to step 835.

At step 835, the control unit 505 may determine whether or not the gas turbine 105 may be ignited by determining if the temperature of the ITS 315 determined at step 833 exceeds the required temperature of the ITS 315 determined at step 832. If, at step 835, the control unit 505 determines that the gas turbine 105 may not be ignited, then the control unit 505 returns to step 830. It will be understood by those of skill in the art that the control unit 505 may also take actions in addition to or as an alternative to returning to step 830. The control unit 505 may, for example, set off an alarm or transfer an alarm message indicating that the temperature of the ITS 315 is not sufficient to allow the gas turbine 105 to be ignited, or the control unit 505 may shut down the gas turbine 105.

If, however; at step 835, the control unit 505 determines that the gas turbine 105 may be ignited, then the control unit 505 goes to step 845 and the gas turbine 105 is ignited.

It will be understood by those of skill in the art that the steps performed by the control unit 505 to determine whether a gas turbine 105 may be ignited or fired do not necessarily have to be performed in the order set forth in the logic of FIG. 8, but instead may be performed in any suitable order. It will also be understood that, if the control unit 505 encounters a problem in the starting or ignition of the gas turbine 105, the control unit 505 may take other control actions instead of or in addition to holding of the gas turbine 105 in its current state such as, for example, setting off an alarm or transmitting an alarm signal to a user of the present invention.

It will also be understood by those of skill in the art that the temperature measurements utilized by the control unit 505 during the steps set forth by FIG. 8 correspond to the clearance of the gas turbine 105. As an alternative to basing start and ignition decisions on the temperature measurements described above with reference to FIG. 8, the control unit 505 may base start and ignition decisions on determined or calculated clearances of the gas turbine 105. The control unit 505 may, for example, determine the current clearance of the gas turbine 105 before determining whether or not the gas turbine 105 may be started and/or ignited. The control unit 505 may determine the current clearance in the same manner as that described above with reference to FIG. 7. The control unit 505 may then compare the current clearances to predefined clearance values necessary to start and/or ignite the gas turbine 105. These predefined clearance values may be stored in the memory 605 of the control unit 505.

This predefined clearance values may be established by a user of the present invention. Additionally, the predefined clearance values may vary depending on a state of the gas turbine 105. For example, before the gas turbine 105 is started or cranked, the predefined value of the clearance may be required to be equal to or greater than approximately 0.08 inches. As another example, before the gas turbine 105 is fired, the predefined value of the clearance may be required to be equal to or greater than approximately 0.04 inches. It will also be understood that other special firing conditions may be established for the gas turbine 105 that may increase or decrease the predefined value required for the turbine clearance. Once such situation may occur in the case of a black start condition in which a portion or all of a power grid has lost power. In this situation, a lower turbine clearance may be tolerated in order to restore power as quickly as possible. For example, in a black start condition, the predefined value of the clearance may be required to be equal to or greater than Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for controlling ignition clearance in a gas turbine, the method comprising:

determining, by a control unit comprising at least one computer processor, a temperature of a shaft of the gas turbine;

calculating, by the control unit based upon the determined temperature of the shaft, a desired temperature of an inner turbine shell of the turbine, wherein the desired temperature is associated with a turbine clearance at which the gas turbine may be ignited;

altering, by the control unit, a temperature of the inner turbine shell by controlling the temperature of a gas that is circulated within the inner turbine shell;

determining, by the control unit, that the temperature of the inner turbine shell exceeds the desired temperature; and igniting, by the control unit, the gas turbine subsequent to the determination that the temperature of the inner turbine shell exceeds the desired temperature.

2. The method of claim 1, wherein determining a temperature of a shaft comprises determining a bulk temperature of the shaft based upon at least one of a predefined model or an equation.

3. The method of claim 1, wherein calculating a desired temperature of an inner turbine shell comprises calculating the desired temperature as a function of the determined temperature of the shaft.

4. The method of claim 1, wherein determining that the temperature of the inner turbine shell exceeds the desired temperature comprises:

receiving, by the control unit from a thermocouple measuring device, a temperature measurement for the inner turbine shell;

comparing, by the control unit, the received temperature measurement to the desired temperature; and determining that the temperature of the inner turbine shell exceeds the desired temperature based upon the comparison.

5. The method of claim 1, wherein controlling the temperature of a gas that is circulated within the inner turbine shell comprises controlling the temperature of a gas that is circulated within a closed-loop system.

6. The method of claim 1, further comprising:

directing, by the control unit subsequent to the determination that the temperature of the inner turbine shell exceeds the desired temperature, the ventilation of the gas turbine;

determining, by the control unit, the temperature of the shaft subsequent to the ventilation; and re-calculating, by the control unit, the desired temperature of the inner turbine shell.

7. The method of claim 6, further comprising:

altering, by the control unit, a temperature of the inner turbine shell by controlling the temperature of a gas that is circulated within the inner turbine shell; and determining, by the control unit, that the temperature of the inner turbine shell exceeds the re-calculated desired temperature, wherein igniting the gas turbine comprises igniting the gas turbine subsequent to the determination that the temperature of the inner turbine shell exceeds the re-calculated desired temperature.

8. The method of claim 1, further comprising:

calculating, by the control unit subsequent to the ignition of the gas turbine, a current clearance between a turbine blade and a casing of the gas turbine;

determining, by the control unit, that the calculated current clearance is outside of a predetermined clearance threshold; and altering, by the control unit, the clearance of the gas turbine by controlling the temperature of the gas that is circulated within the inner turbine shell.

9. The method of claim 8, wherein calculating the current clearance comprises:

determining a current operating condition and a current operating temperature of the gas turbine;

calculating a mechanical growth and a thermal growth of the gas turbine based on the current operating condition and the current operating temperature; and adjusting a predefined initial clearance of the gas turbine based on the calculated mechanical growth and the calculated thermal growth.

10. The method of claim 9, wherein calculating a mechanical growth and a thermal growth comprises calculating at least one of a mechanical growth and a thermal growth of the shaft, a mechanical growth and a thermal growth of a turbine blade of the gas turbine, a thermal growth of a shroud of the gas turbine, or a thermal growth of a casing of the gas turbine.

* * * * *